United States Patent [19]

McKay

[11] Patent Number: 4,881,845

[45] Date of Patent: Nov. 21, 1989

[54] MOVEABLE ROADWAY BARRIER SYSTEM

[76] Inventor: Alan R. McKay, 1126 Hilltop Dr., Lafayette, Calif. 94549

[21] Appl. No.: 220,926

[22] Filed: Jul. 18, 1988

Related U.S. Application Data

[63] Continuation of Ser. No. 815,456, Jan. 2, 1986, abandoned.

[51] Int. Cl.[4] ..... E01F 13/00

[52] U.S. Cl. ..... 404/6; 256/13.1

[58] Field of Search ..... 404/6, 9, 13; 256/13.1

[56] References Cited

U.S. PATENT DOCUMENTS

| | | | |
|---|---|---|---|
| 3,958,890 | 5/1976 | Ferrari | 404/9 |
| 4,017,200 | 4/1977 | Woods, Jr. | 404/9 X |
| 4,185,265 | 1/1980 | Griffin et al. | 404/9 X |
| 4,406,563 | 9/1983 | Urlberger | 404/6 |
| 4,474,503 | 10/1984 | Booth et al. | 404/6 |
| 4,498,803 | 2/1985 | Quittner | 404/13 X |
| 4,500,225 | 2/1985 | Quittner | 404/6 |
| 4,629,357 | 12/1986 | Wattenburg et al. | 404/6 |
| 4,653,954 | 3/1987 | Booth et al. | 404/6 |

*Primary Examiner*—Jerome W. Massie, IV
*Assistant Examiner*—Matthew Smith
*Attorney, Agent, or Firm*—Flehr, Hohbach, Test, Albritton & Herbert

[57] ABSTRACT

A moveable roadway barrier system comprising a number of interconnected barrier sections of substantial length which can be moved to change the direction of traffic flow or for other reasons by a self-propelled or towable vehicle without disconnecting adjacent barrier sections. Barrier sections which have glare screens or other devices protruding above the top of the barrier can be transferred by the system. Existing barrier sections of various lengths and profiles can be retrofitted for transfer by the system.

13 Claims, 7 Drawing Sheets

MOVEABLE ROADWAY BARRIER SYSTEM

This application is a continuation of Ser. No. 815,456, filed Jan. 2, 1986 now abandoned.

FIELD OF THE INVENTION

This invention relates to system for spacing and locking, unlocking, transferring, and respacing and relocking in place, roadway barriers of substantial length, in a manner such that the transfer of the barriers to increase or decrease the number of lanes available in a particular direction can be accomplished in a timely manner.

PRIOR ART AND THE PRESENT INVENTION

Other types of barriers and mechanisms, such as those disclosed in U.S. Pat. Nos. 4,474,503 and 4,500,225 provide means for transferring barrier sections from lane to lane. However, these systems use wheels or rollers which pick up the barrier sections from beneath the extended top flange of the barrier, with the supporting wheels being numerous, closely spaced, and with a row of wheels on each side of the web of the barrier, set to relatively close tolerances, so that, during transfer, the barrier is forced to travel through what is, in effect, a narrow winding channel, which severely limits the length of the individual sections. This limited length of the individual barrier sections leads to the condition that there is insufficient mass in any one section to effectively resist the impact force of a crashing vehicle, and complicated locking or torsion devices are thus needed to promote interaction between adjoining units. Another deficiency of these systems is that the transfer vehicles protrude beyond the barrier into the active traffic lanes, creating a hazard.

As will be seen, the present invention suffers from none of these disadvantages. The barrier sections are engaged by the transfer vehicle at each end only of each section. Offsets between the barrier section and the profile of the transfer beam are thus of no consequence, and there is thus no theoretical limit to the length of the barrier sections which can be transferred. Practical considerations of manufacturing, and of transportation to the site, are the major factors limiting length. It will be demonstrated in the specific description which follows that the transfer vehicle and mechanisms are protected from passing traffic, and that the transfer operation poses no hazard to that traffic.

BRIEF DESCRIPTION OF THE DRAWINGS

The objects, features, and advantages of the present invention will become readily apparent from the description that follows, reference being made to the accompanying drawings, in which.

SPECIFIC DESCRIPTION

Figure 1:
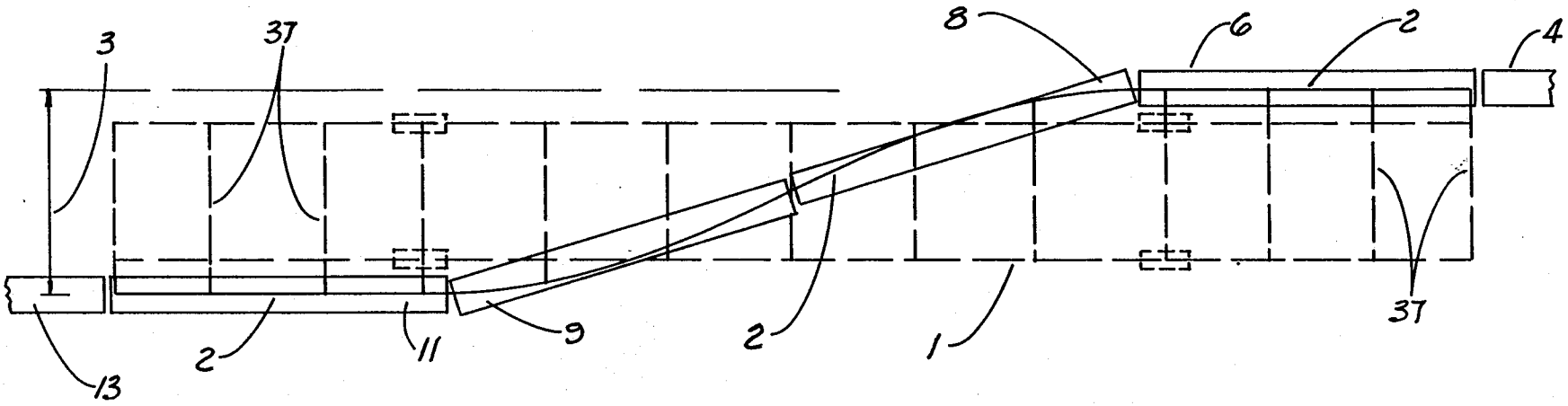
FIG 1 is a diagrammatic plan showing an embodiment of the transfer system. In this figure, the vehicle is moving to the right of the figure, and the barrier is being transferred from top to bottom of the figure.
Figure 2:
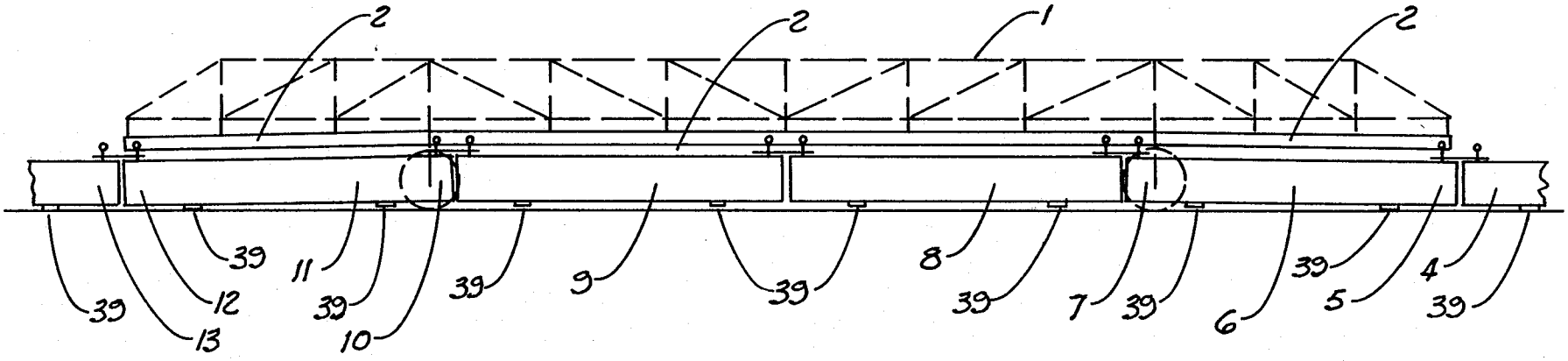
FIG. 2 is a diagrammatic elevation of an embodiment of the invention showing the barrier sections being picked up, transferred, and then set down as the vehicle moves to the right.

As previously noted, in FIGS. 1 and 2 the transfer vehicle 1 is moving to the right. The transfer vehicle has four or more wheels, and is, in the preferred embodiment, self-powered, but could be towable. Below the main frame of the vehicle is slung and fixed in place a transfer beam 2. The forward section of this beam is straight, and tangent to a double-curving section, with another straight section at the rear of the vehicle tangent to the double-curved section. The curved section of the beam is maintained parallel to the roadway surface, with the forward straight section sloping upward from forward to rear, and with the rearward straight section sloping downward from forward to rear. The offset 3 between the straight sections of beam is set for the desired width of lane transfer.

In FIGS. 1 and 2, barrier section 4 has not yet been engaged by the transfer beam, the forward end 5 of the barrier section 6 is in the process of being engaged, while the rearward end 7 of barrier section 6 has travelled up the sloping section of beam and has thus been lifted clear of the roadway, but has not yet entered the curving section of the beam. The forward end 10 of barrier section 11 is still suspended, while the rearward end 12 of barrier section 11 has travelled down the sloping section of the beam, and is about to be disengaged from the vehicle. Barrier section 13 has already been set in place.

Figure 4:
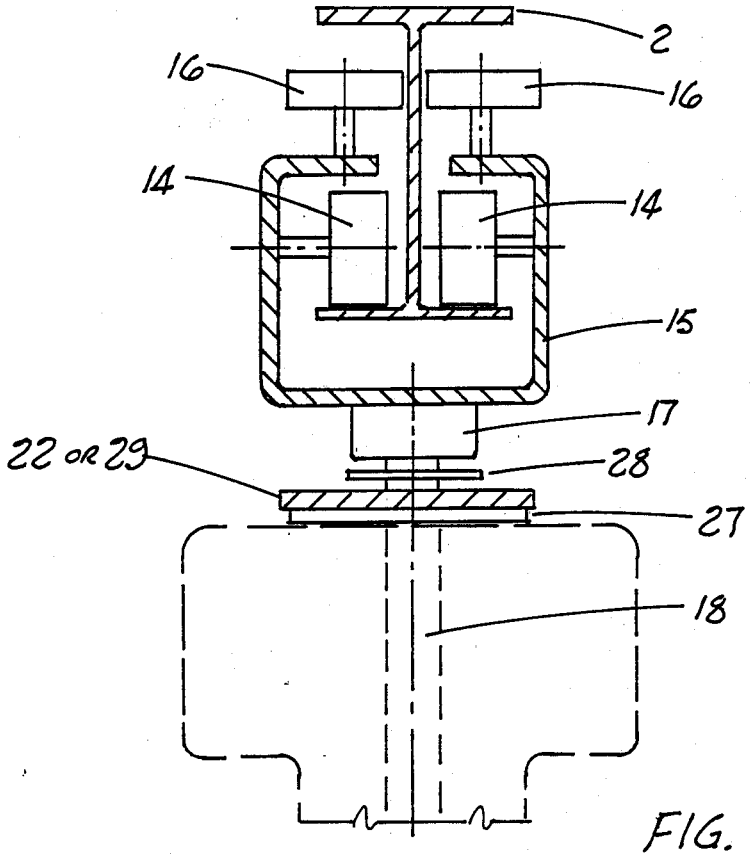
FIG. 4 is a sectional elevation of an embodiment of the assembly by which the barrier units are supported during transfer.
Figure 5:
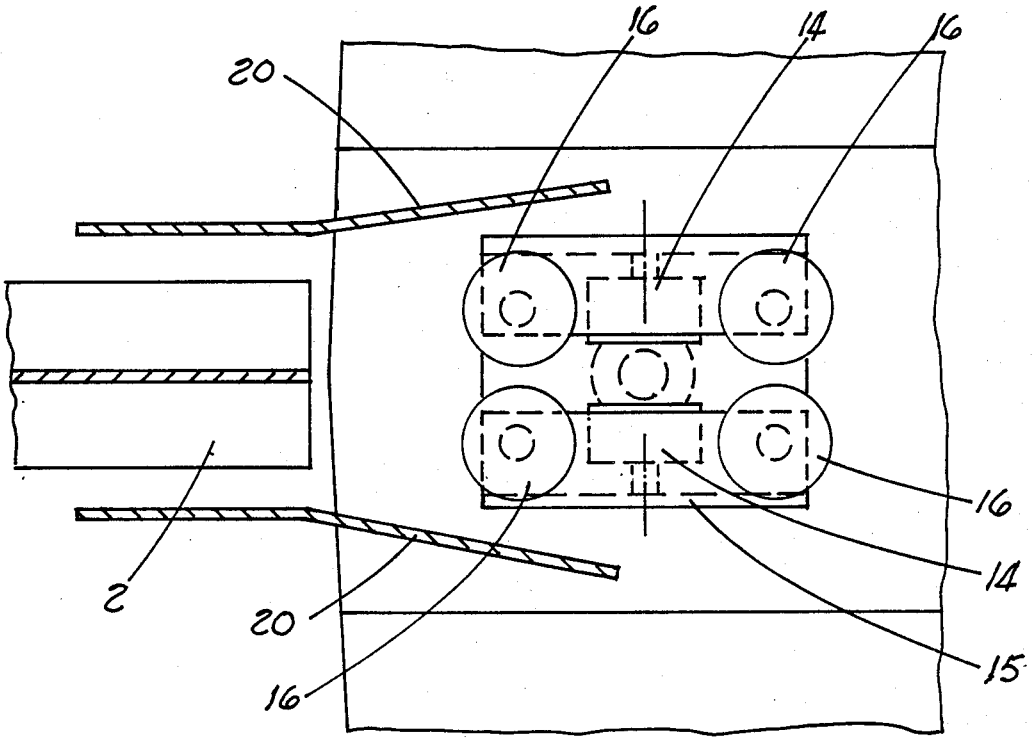
FIG. 5 is a sectional plan cut immediately above the top surface of the horizontal guide rollers of an embodiment of the invention, just prior to the engagement of the pick-up beam. In this figure, the vehicle is moving to the right. For clarity, the adjacent barrier unit, and the locking plate are not shown.
Figure 6:
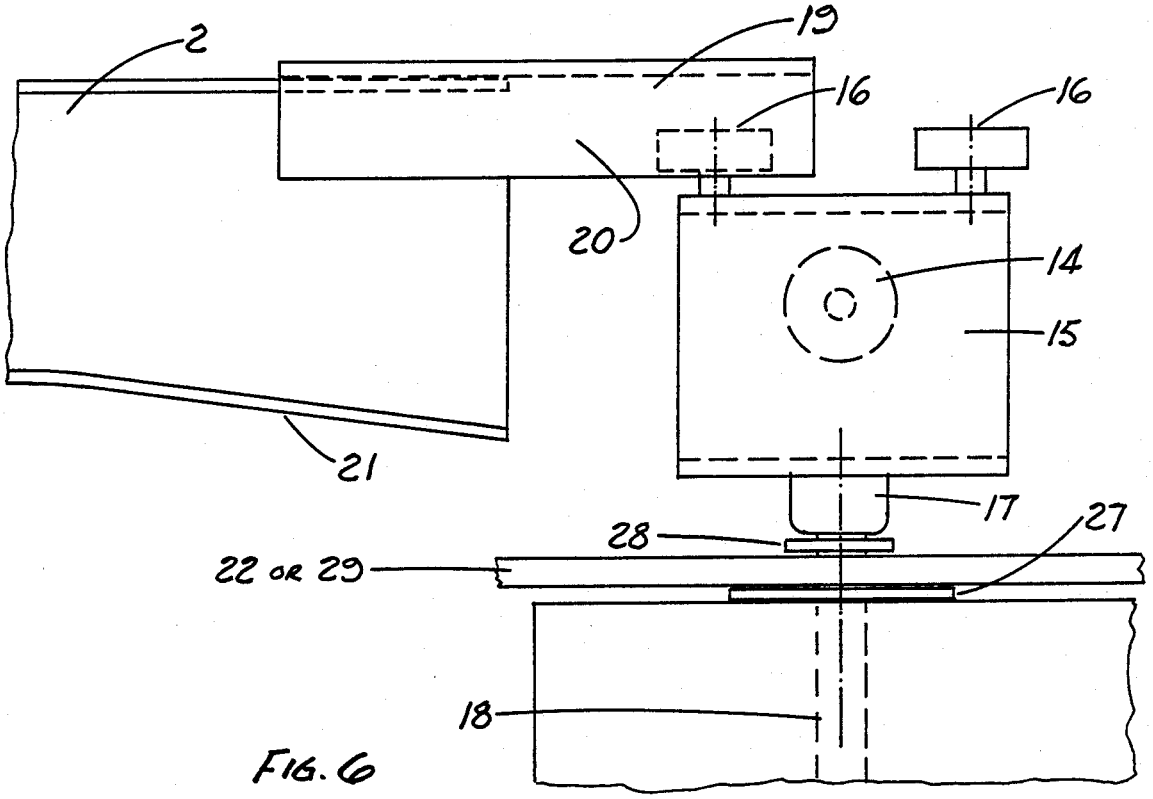
FIG. 6 is an elevation of an embodiment of the invention showing the condition just prior to engagement of the pick-up beam. In this figure the vehicle is moving to the right. For clarity, the adjacent barrier unit is not shown.

FIGS. 4, 5 and 6 give details of an embodiment of the pick-up mechanism. The transfer beam 2 is either a rolled structural shape, or a shape fabricated from plate, in which the upper surface of the lower flange is horizontal (non-tapered). Rollers 14 which are steel, or steel with tires of urethane or other suitable materials, are roll along the bottom flange of beam 2 and are attached by the yoke plate 15. Guide rollers 16 which are also of steel, or of steel with tires of urethane or other suitable materials, are located on either side of the vertical web of beam 2, and are spaced such that the clear distance between them is slightly greater than the thickness of the web. These rollers 16 are also attached to the yoke plate 15. The boss 17 is rigidly attached to the yoke plate 15 and is attached to a vertical bar 18 in such a manner that it can rotate or swivel about the vertical axis of bar 18, with the angle of rotation either side of center limited to a few degrees greater than the greatest angle subtended between the centerline of the barrier section and the tangent of the curved beam as the barrier moves along the beam. In FIGS. 5 and 6 the transfer beam, which is moving to the right, is about to engage the suspension and guiding assembly. A guide channel 19 is attached to the top flange of the transfer beam 2 and the splayed vertical legs 20 of this channel serve to guide the rollers 16 into position on either side of the vertical web of beam 2. A short sloping section, 21, of the lower flange of beam 2 serves to ensure that the rollers 14 are properly engaged.

Figure 7:
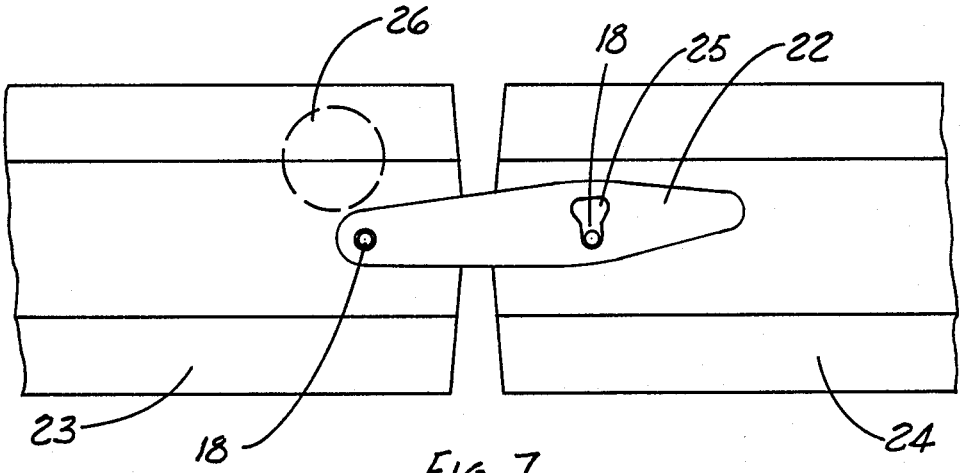
FIG. 7 is a plan showing an embodiment of the spacing and locking system, shown in the locked position.
Figure 8:
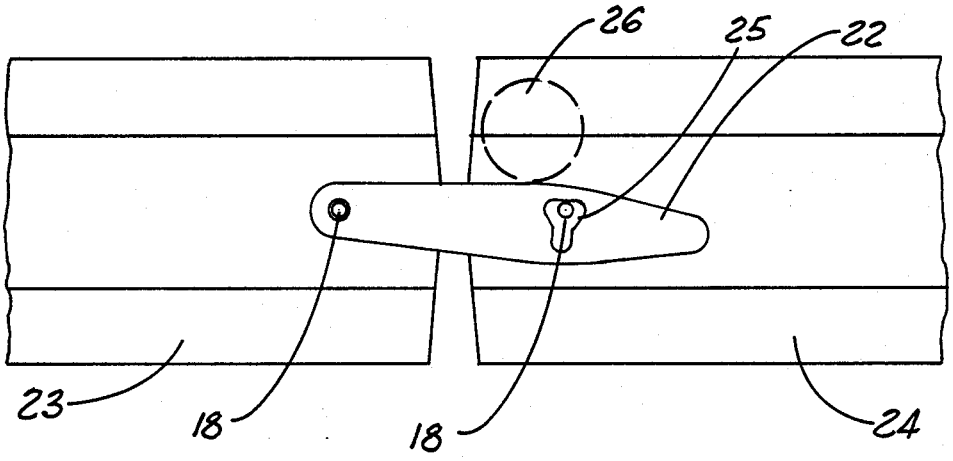
FIG. 8 is a plan of an embodiment of a spacing and locking system, shown in the unlocked position.

FIGS. 7 and 8 illustrate a preferred embodiment of the spacing and locking mechanism. Shaped steel 22, free to rotate about the vertical bar 18 of barrier section 23, is attached to the vertical bar 18 of barrier section 24 through opening 25. In FIG. 7, which illustrates the locked position, the plate 22 has been moved to a position such that the vertical bar 18 of barrier section 24 is in the slot of the shaped opening, being held in that position by spring-loaded detente balls or other locking devices (not shown). The horizontal wheel 26, which is attached to the transfer vehicle, and is moving to the right, is about to engage plate 22 and move it to the position shown im FIG. 8, in which bar 18 of barrier section 24 has a limited degree of freedom of movement with respect to plate 22. This limited degree of freedom and consequent limited ability for the spacing of the barrier sections to change is necessary to allow for the constantly changing geometry as the barrier units move along the curved transfer beam. The bar 22 is moved to the position shown in FIG 8 shortly after the unit is engaged by the transfer vehicle. Shortly before the unit is set down after passing through the transfer vehicle, bar 22 is moved back to the position shown in FIG. 7 by another horizontal wheel which engages the opposite side of bar 22 from that engaged by wheel 26, and which, for clarity, is not shown.

Bar 22 is being held clear of the upper surface of the barrier by a washer 27 of fluorocarbon or similar material. Another washer 28, also of fluorocarbon or similar material,is located between plate 22 and boss 17. See FIGS. 4 and 5.

Figure 9:
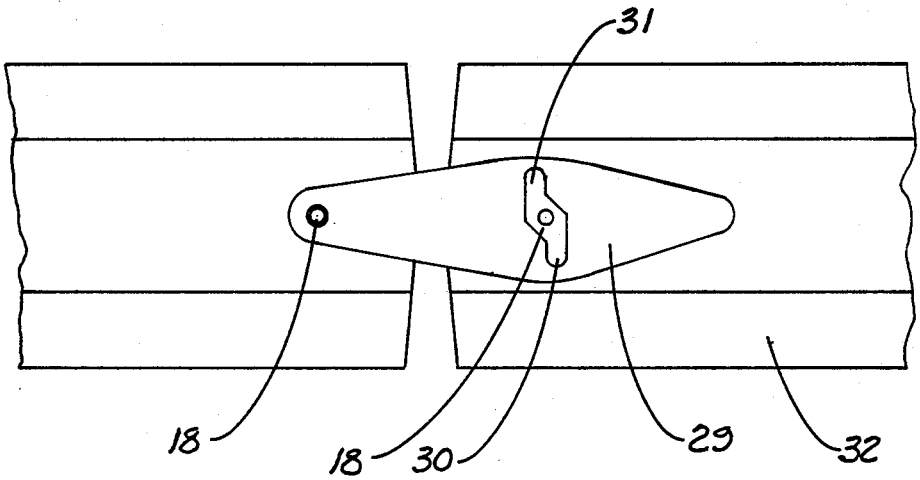
FIG. 9 is a plan showing an embodiment of a locking system which allows the units to be spaced and locked at either one of two different pre-determined spacings.

When the barriers are used in locations where the road is curving horizontally, there is a need to change the spacing between the barrier sections to match the difference in arc dimension between the barrier position which has the greater radius and the barrier position which has the lesser radius. FIG. 9 shows an embodiment of the spacing and locking mechanism which allows the the barrier sections to be locked at either one of two predetermined spacings or to have a limited degree of freedom. In the position, shown the vertical bar 18 of barrier section 32 has a limited degree of freedom in relation to plate 29. To space and lock the sections for the greater length required by the larger radius of curvature, the plate 29 is moved in the upward direction in FIG. 9, forcing bar 18 into slot 30. To space and lock for the smaller radius, bar 18 is forced into slot 31.

Figure 3:
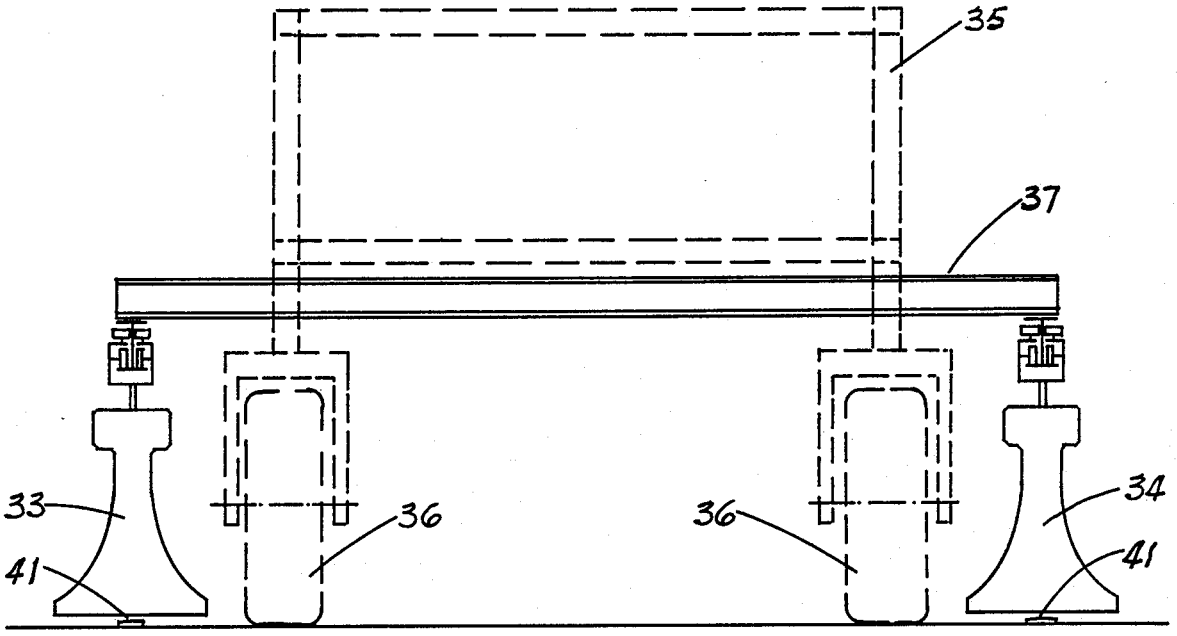
FIG. 3 is a diagrammatic section, looking through the vehicle in the direction of travel, showing the barrier line at left, prior to transfer, and at the right, after transfer.

As is shown diagrammatically in FIG. 1, the transfer vehicle is protected from traffic by the barriers—from oncoming traffic by the barriers which have not yet been transferred; from following traffic by the barriers which have been transferred and placed in their new position. This is further illustrated in FIG. 3, which is a section looking in the direction of travel. The barriers to the left of 33 are shown in the location prior to transfer, with the barriers 34 shown in the location after transfer. The main structure 35 and the wheels 36 of the transfer vehicle, which are shown dashed, are clearly within the protected area between the barriers. The transfer beams 37, which directly support the transfer beam 2, are drawn bold in this figure to clearly illustrate that all parts of the vehicle and mechanism are protected.

The mechanism and system of the present invention can be used to transfer barrier sections of almost any profile, and in lengths up to and beyond that of commonly used barriers which, before the present invention, had to be moved by crane, one section at a time. The barrier sections can be made of steel, reinforced concrete or other commonly available materials. However, in the preferred embodiment, the barriers are of prestressed concrete, using concrete made with heavy aggregates, such as steel slag, which concrete is commonly produced in weights of 300 pounds per cubic feet or more, to increase the mass of the barriers. The preferred profile is similar to that shown in FIG. 10. This profile is similar to those presently being used by many Highway Departments for both fixed and temporary barriers, with the following exceptions and additions.

Figure 10:
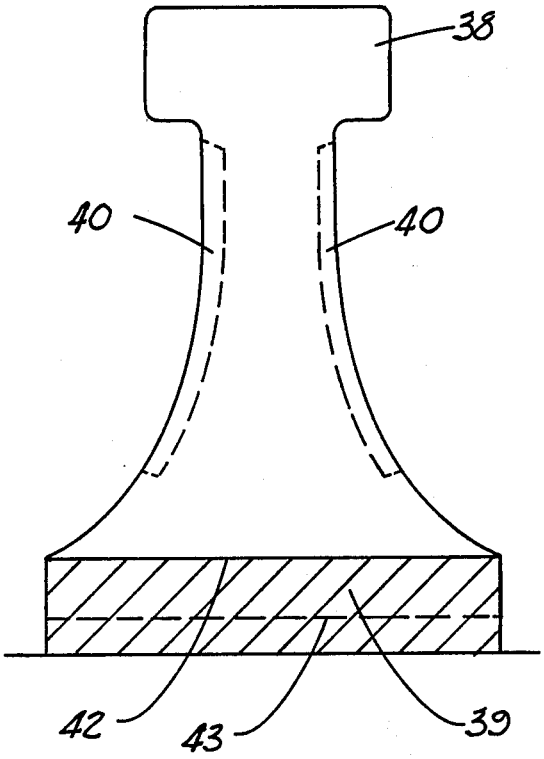
FIG. 10 is a vertical section showing the preferred profile of the barrier.
Figure 11:
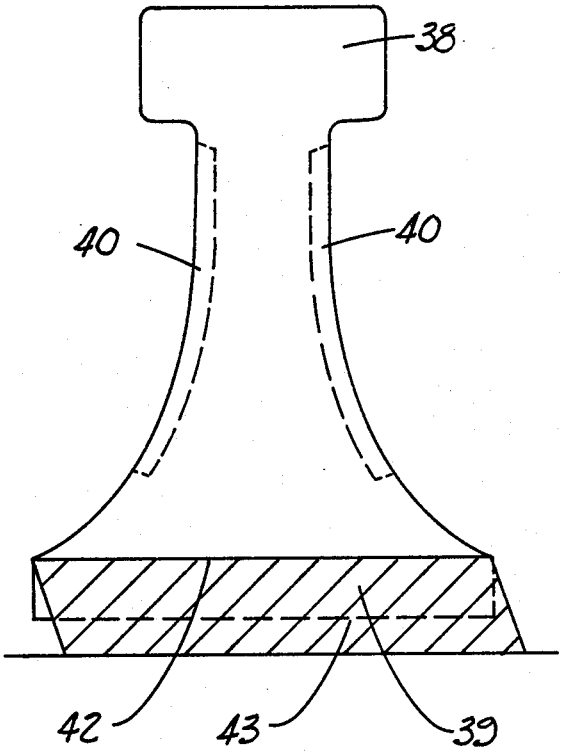
FIG. 11 is a vertical section through the barrier showing the shear deflection of the support pad during impact.
Figure 12:
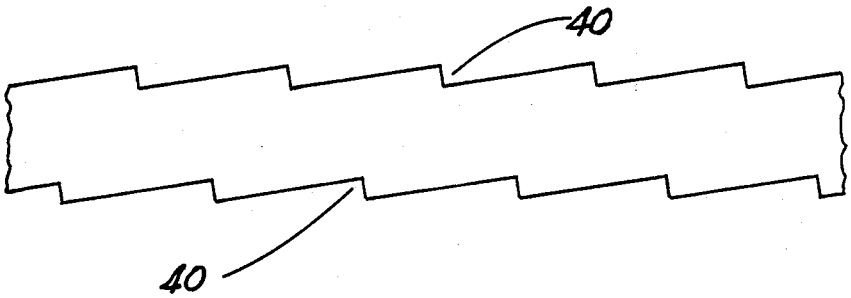
FIG. 12 is a horizontal section through the web of the barrier showing the preferred profile of the "indented" striations.

The flange, 38, has been added at the top of the barrier to increase the mass and strength of the top of the barrier, and also to prevent or inhibit vehicles from climbing or sliding over the barrier. Striations, 40, which are indicated on FIGS. 10 and 11, are cast into the sides of the barrier. These striations can be of many profiles, but the preferred profile is that shown in FIG. 12, which is a horizontal section through the web of the barrier. The purpose of these striations is to aid in bringing a crashing vehicle to a safe stop by promoting mechanical work between the barrier and the vehicle, thus scrubbing off the energy of the crashing vehicle, and, by the dragging force produced, to promote continuous contact between the vehicle and the barrier, thus preventing or inhibiting the vehicle from bouncing off the barrier into the adjacent following traffic.

In the preferred embodiment, the barriers are held clear of the roadway by pads, 39, with two pads for each barrier section, located at approximately twenty percent of the barrier length from each end of the section. These pads,which,in the preferred embodiment are off rubber, but which can be of other materials with a relatively low shear modulus, are bonded to the underside of the barrier sections, as indicated in FIGS. 10 and 1. By holding the barriers clear of the roadway they perform multiple functions.—Surface water can drain freely beneath the barrier; lane marker buttons or reflectors, 41, can be used to delineate all lanes without danger of being destroyed during the lane transfer operation; and unevenness in the roadway surface,including the marker buttons or reflectors, presents no problems of rocking or instability.

Most importantly, however, the barrier section is held against lateral movement at only two points and can deflect in bending between and beyond the support points. The pads themselves, being of material with a low shear modulus, can also deflect under load as is illustrated in FIG. 11, which shows the deflected shape of pad 39 due to an impact force acting from right to left. The combination of bending deflection of the barrier between and beyond the support points and the shear deflection of the support pads provides the system with a large energy absorption capacity, and, by decreasing the rate of deceleration of the crashing vehicle, reduces the impact forces. In the preferred embodiment shown in FIGS. 10 and 11 the pads are bonded to the recessed surface 42. The profile of the bottom of the barrier beyond the recess is indicated by line 43.

The principal application of the present invention is to provide a moveable barrier between opposing lanes of traffic. For this application, as is illustrated diagrammatically in FIG. 1, as the vehicle moves to the right the barriers are transferred from the top to the bottom of the figure, or from left to right when facing in the direction of travel. To transfer the barriers back to the original position the vehicle direction is reversed, and with the vehicle travelling to the left in the figure the barriers are moved from the bottom to the top of the figure, which is again from left to right when facing in the direction of travel.

Figure 13:
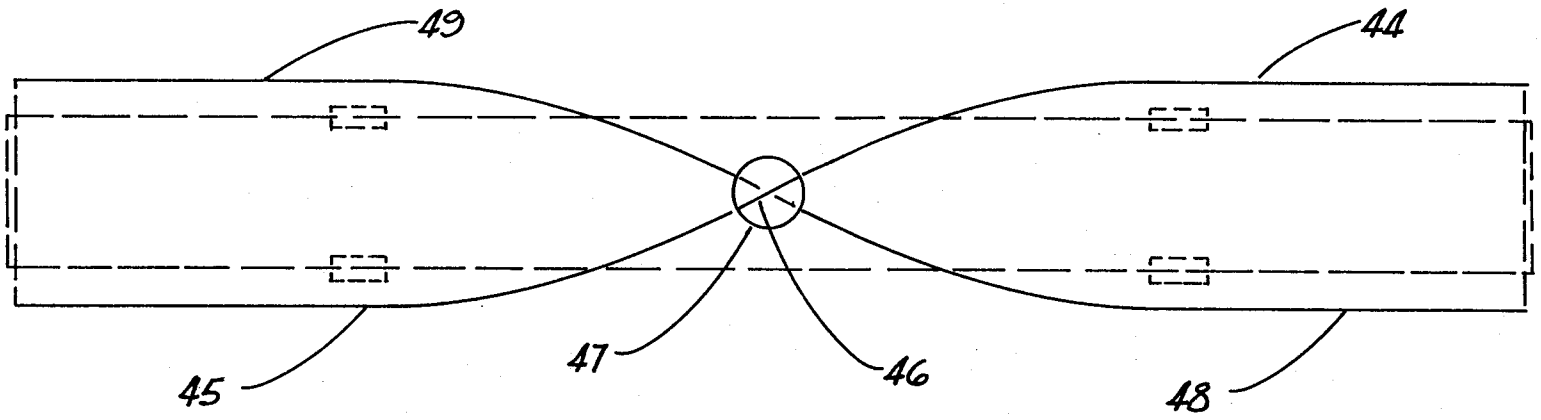
FIG. 13 is a diagrammatic plan which shows an embodiment which allows transfer of lanes either from left to right or from right to left, with the ability to quickly change the direction of transfer.

There are situations, such as the protection of roadside construction activities, where it may be necessary or desirable to move either from left to right or from right to left when facing in the direction of travel, and this can be accomplished with the embodiment of the invention illustrated diagrammatically in FIG. 13. In this embodiment, to transfer from left to right while facing in the direction of travel beam sections 44 and 45 are joined by the short beam section 46 to form a continuous beam. To reverse the direction of transfer from right to left when facing in the direction of travel beam sections 48 and 49 are joined by the short section 46, which is moved to the position indicated by the dashed line by rotation of the turntable 47. With this embodiment the direction of transfer can be changed in a matter of minutes.

As previously noted, the vehicle has, in its preferred embodiment, four wheels. These wheels are independently steerable, but the steering mechanism is such that the two front wheels can be steered together and the two rear wheels steered together. It should be noted that this and other references to front and rear are for convenience of reference only, since, as the vehicle is reversible and performs its transfer operation while travelling in either direction, front and rear are also reversible and a function of the particular direction in which the vehicle is proceeding at the time of reference. A driving position from which both the movement and steering of the vehicle can be controlled is located at each end of the vehicle. While the vehicle can be steered form these locations, such manual steering is normally only used when moving the vehicle from its parking area and into the position from which it starts the transfer operation. During the transfer operation the vehicle is guided by sensors located at each end of the of the vehicle which can sense the location of the cable buried at a shallow depth below the surface of the roadway, and which, through a servomechanism connected to the steering, can guide the vehicle to ensure accurate pick-up and placement of the barrier.

The mounting height above the top of the barrier section of the assembly described in FIGS. 4,5 and 6 of not limited, and thus barriers which have glare screens or other devices projecting above the top of the barrier can be transferred by the system. The assembly described in FIGS. 4,5 and 6 is such that it can easily be retrofitted to existing barrier sections. These sections can then be spaced and locked, unlocked, transferred, respaced and relocked into place, by the transfer vehicle of the present invention in a similar manner to that of barrier sections of the present invention.

It will be apparent to those with knowledge in the general area of the present invention that the invention is not limited to the specific disclosures detailed herein and that variations from the disclosures could be made without departing from the spirit of the invention.

I claim:

1. A traffic barrier system which provides a safe separation between opposing lanes of vehicular traffic and is capable of being moved across lanes to change the direction of traffic lane flow comprising:

a plurality of barrier sections, having top, bottom and side surfaces, pivotably connected together adjacent the ends thereof, a vehicle capable of laterally transferring said barrier sections having thereon transfer beam means constructed to provide movement of said barrier sections from one side of said vehicle to the other side as the vehicle travels in one direction;

a pair of longitudinally spaced apart elements attached to said top surface of each barrier section only adjacent the barrier ends;

said transfer beam means and said longitudinally spaced apart elements including roller means rotatably fixed thereto for moving said barrier sections relative to said transfer beam means, the other of said transfer beam means and said longitudinally spaced apart elements including rail means engageable with said roller means;

whereby when said vehicle travels in said one direction, the transfer beam means engage the roller means consecutively for lateral displacement of the barrier sections.

2. A traffic barrier system as in claim 20 having an inplace support system which holds the barrier between one and six inches above the roadway surface to allow free flow of surface drainage and to allow the use of marker buttons or reflectors for the demarcation of the lane boundaries comprising two pads of rubber or other materials one each of which is bonded to the underside of the barrier section at or near the end of the barrier section.

3. A traffic barrier system as in claim 2 in which the support system holds the barrier free of the roadway which support at only two points and allows elastic bending deflection of the barrier between and beyond the support points thus absorbing crash energy and decreasing crash impact forces.

4. The traffic barrier system of claim 3 in which the support system comprises support pads made of material with a low shear modulus allows shear deflection of the pads under the action of horizontal loads with consequent controlled displacement of the barrier thus absorbing energy and decreasing crash impact forces.

5. The traffic system of claim 1 wherein the transfer vehicle is a self-powered or towable road vehicle which has a frame supported by four or more wheels from which the frame is suspended, said transfer beam means being a continuous beam of steel having the same cross-sectional profile as a rolled structural steel beam with the beam supported in such a manner that the web is vertical, which beam has a first section which is straight in plan and has its longitudinal axis parallel to the longitudinal axis of the transfer vehicle with the forward end of this first section of beam being lower than the rearward end and with this straight section of beam being joined at its rearward end to the forward end of a second section of beam which is double-curved in plan and which is held parallel to the roadway surface and which is joined at its rearward end to the forward end of a third straight section of beam which is aligned with its longitudinal axis facing to the rear and with the rearward end of this third section of beam being lower than the forward end and with all three sections of beam being joined to form a continuous beam with the ends of the straight sections being tangent to the curve of the curving section at their point of meeting and with the horizontal offset between the longitudinal axes of the straight sections of beam defining the distance areas which the barrier lines are transferred with all references to forward or rearward meaning forward or rearward when facing in the direction of travel of the vehicle.

6. The traffic barrier system of claim 1 wherein the elements which support the barrier sections during the transfer operation are supported during transfer by the transfer beam means which comprises wheels or rollers of steel which roll along the top of the bottom flange of the beam means on each side of the web of that beam and further comprises wheels or rollers of steel each rotating about a vertical axis and being disposed on each side of the web of the beam means in two sets of opposed pairs of wheel or rollers with one set of opposed wheels or rollers located on either side of the wheels or rollers which are supported by the bottom flange of the steel beam and further comprising a yoke plate of steel to which all of the wheels or rollers are attached and with the yoke plate attached to a vertical bar which is embedded in the barrier with the attachment such that the yoke plate with its attached wheels or rollers has the ability to rotate about the vertical axis of the vertical bar.

7. The traffic barrier system of claim 1 wherein the elements of claim 6 are engaged by the transfer beam means of the vehicle and are forced by the movement of the vehicle to climb said straight first section of beam which is closest to the front of the vehicle thereby lifting the barrier sections to which they are attached clear of the roadway and are then forced to enter and travel the second curving section of beam thereby transferring the barrier section toward the intended new location of the barrier line and are then forced to enter and move down the rearward straight third section of beam thereby placing the barrier section to which they are attached in the intended new location of the barrier line with the whole operation taking place in a manner such that each barrier section remains connected to the adjacent sections and follows the section in front and to which it is attached through the cycle of pickup transfer and placement.

8. The traffic barrier system of claim 4 wherein each barrier section has only two of the elements described in claim 6 one element within about two feet of each end of each barrier section so that the barrier sections are supported by the transfer beam at only two points per barrier section with the result that the length of the individual barrier sections can be transferred by the system could be as much as forty feet.

9. The traffic barrier system of claim 1 wherein no part of the transfer vehicle or transfer element projects beyond the barrier into the active traffic lanes, thus creating no hazard to vehicles in the adjacent active traffic lanes.

10. The traffic barrier system of claim 1 wherein due to the fact that the interface between the transfer vehicle and the devices which support the said barrier sections can be as much as four feet above the top of the barrier, such devices as glare screens are no impediment to the transfer of the barrier sections through the transfer vehicle.

11. The system of claim 1 whereby the transfer vehicle can either be steered manually or can be guided by a device which senses the location of a cable buried under the surface of the roadway over which the vehicle is travelling and which controls the steering thereby ensuring accurate pick-up and placement of the barrier.

12. The traffic barrier system of claim 1 whereby the support element of claim 7 can be attached to existing barrier sections thereby allowing those barrier sections to be spaced, locked, unlocked, transferred, respaced and relocked in a manner similar to that of barrier sections specifically manufactured to comply with the intent of the present invention.

13. The barrier section in claim 1 manufactured of prestressed concrete to provide flexibility with strength thus promoting absorption of the energy of crashing vehicles.

* * * * *